US005588170A

United States Patent [19]

Strahm

[11] Patent Number: 5,588,170

[45] Date of Patent: Dec. 31, 1996

[54] METHOD AND DEVICE FOR TREATING AN IN PARTICULAR TENSION-SENSITIVE TEXTILE WEB

[75] Inventor: Christian Strahm, Bronschhofen, Switzerland

[73] Assignee: Solipat AG, Zug, Switzerland

[21] Appl. No.: 375,653

[22] Filed: Jan. 20, 1995

[30] Foreign Application Priority Data

Jan. 28, 1994 [CH] Switzerland ..... 00254/94

[51] Int. Cl.[6] ..... D06B 3/12

[52] U.S. Cl. ..... 8/149.1; 8/151; 8/151.1

[58] Field of Search ..... 68/158, 157, 178, 68/5 D; 8/151, 151.1, 149.1

[56] References Cited

U.S. PATENT DOCUMENTS

| | | | |
|---|---|---|---|
| 3,885,262 | 5/1975 | Riedel | 68/5 D |
| 3,981,162 | 9/1976 | Klier | 68/9 |
| 4,004,879 | 1/1977 | Windhorst et al. | 68/5 D |
| 4,056,352 | 11/1977 | Mayer | 68/5 D |
| 4,624,023 | 11/1986 | Fleissner | 8/151 |
| 5,046,338 | 9/1991 | Luthi | 68/158 |
| 5,137,756 | 8/1992 | Harada | 68/9 |
| 5,195,201 | 3/1993 | Schlicht | 8/151 |

FOREIGN PATENT DOCUMENTS

| | | | |
|---|---|---|---|
| 1109965 | 2/1956 | France | 8/151 |
| 2521407 | of 0000 | Germany . | |
| 1917759 | of 0000 | Germany . | |
| 4121593 | 1/1993 | Germany | 68/158 |
| 91/04367 | of 0000 | WIPO . | |

*Primary Examiner*—Frankie L. Stinson
*Attorney, Agent, or Firm*—Shoemaker and Mattare, Ltd.

[57] ABSTRACT

The textile web (1) is guided through a relatively narrow shaft the limits of which are formed at least partially by the surface of rollers (2, 3). Nozzles (7), from which a treatment medium can be applied onto the textile web, are arranged in the curved sections (6, 6') of the shaft. Straight sections (8) between the rollers can be kept very short. The device is especially suitable for the treatment of tension-sensitive textile webs.

15 Claims, 5 Drawing Sheets

METHOD AND DEVICE FOR TREATING AN IN PARTICULAR TENSION-SENSITIVE TEXTILE WEB

The invention concerns a method and a device for the treatment of a tension-sensitive textile web. The invention serves to subject continuously guided textile webs to washing, impregnation or other treatments with a liquid treatment medium.

BACKGROUND OF THE INVENTION

It is known to apply the treatment medium via nozzles onto the textile web, the application occurring on a straight section of the web or on a section of the web which is curved around a roller. Internation publication WO 91/04367 describes a treatment method where the textile web is guided in an extended condition through a narrow shaft, and where if necessary different treatment mediums, such as water, hot vapour or hot air are applied to the textile web under pressure. For the treatment of knitted goods, such as tricot, this method is unsuitable because of its relatively long unsupported lengths. A related and comparable device is made known in German document DE-A-25 21 407, where the treatment medium is sprayed onto the web and is then immediately removed from the same side of the web by suction. This procedure can be carried out both on straight and curved sections of the web. Extended action of the treatment medium on the textile web is here not possible, the case with vaporific treatment mediums. German document DE-A-19 17 759 describes the treatment of a tension-sensitive textile web, with the textile web being guided along a continuously constrained web path around rollers through which a treatment liquid flows. Forced penetration of the liquid through the textile web does occur, although its effect will not be as intensive as is possible when using nozzles.

SUMMARY OF THE INVENTION

It is therefore a purpose of the invention to create a method and a device of the type mentioned above in order to achieve intensive treatment while exploiting a jet effect, for knitted goods which are elastic in the longitudinal direction, and for textile webs which are sensitive to tension. This purpose is fulfilled by the method and apparatus described below.

The extension of the narrow shaft around the wrap-around area of the rollers together with the arrangement of nozzles in the curved area will on the one hand enable exploitation of the entire travel distance of the textile web. In the curved area, the textile web attains a tensioned surface and will thus be particularly absorbent with regard to treatment medium. The rollers can be placed relatively close to each other so than no potentially damaging freely-suspended lengths are required. An intense flow will develop over the entire length of the shaft, taking effect on the textile web for the entire time it passes through the shaft.

Preferably, the textile web within the shaft is subjected to curving at least once on each of its sides while being acted upon by the treatment medium. With that, equally intense treatment on both sides will be ensured. This is particularly significant in the case of guided wide, tubular knitted-fabric, for example.

In certain cases it is also conceivable to arrange the curved shaft around a single roller only, curving the shaft through 180° and employing auxiliary rollers, for example.

During treatment, the textile web can also be guided with a continuously constrained web path, so that the individual rollers are almost in contact with each other. In this case, the shaft then assumes a continuously and alternatingly curved shape.

For certain treatment procedures it is also advantageous if the textile web is first of all guided around an upper roller where the treatment medium is applied under pressure, and if the textile web is then guided around a lower roller where it is immersed in a bath containing liquid treatment medium. The curved shaft can in this case be completely filled with liquid at the lower roller, which nevertheless does not preclude that liquid from being directed under pressure onto the textile web in this area. The lower shaft can, however, also serve merely as a collector reservoir for treatment medium from the upper shaft.

Hot vapour, saturated steam or water can be applied to the textile web under pressure either in combination or separately. It is at the same time also conceivable to connect individual nozzles to different treatment medium sources, or to alternate these connections by means of corresponding control valves.

Particulary good results can be achieved on the surface of the textile web if, in relation to the course of the shaft, liquid and vaporific treatment mediums are applied alternately. The surface of the textile web will be disrupted through pressurised application of hot vapour, and the application of liquid, in particular fresh water, will raise the wash-effect.

The two consecutively arranged rollers preferably form at least two opposing curved sections. In certain cases it is also conceivable that the curved shaft with nozzles may be provided only at one roller, while the other roller possesses either no curved shaft at all, or a shaft without nozzles, the shaft only being rinsed through with a liquid, for example.

A straight shaft section can be arranged between both curved shaft sections or between both rollers. For example, a machine for washing printed textile webs can be constructed with particular advantage if two rollers are arranged one above the other, with a shaft extending around the upper surface of the upper roller and a shaft extending around the bottom surface of the lower roller, and if the surfaces of the rollers facing each other which are not associated with a shaft are enclosed by a common housing. The liquid or distillate from the upper shaft will in this case run freely into the lower shaft, the lower shaft in principle taking the form of a bath.

It is also not absolutely necessary that the rollers have a closed and regular surface. At least one roller can be designed as a perforated drum, for example, its inside being able to be connected to a suction-extraction means. Either axially or circumferentially, the rollers or drums could also possess a corrugated shape. The distance between the walls of the shaft lies within the range of 3 to 30 mm, preferably between 5 and 10 mm.

Extraction of liquid or gaseous treatment medium from the shaft is accomplished by appropriate drainage piping in the walls of the shaft.

In certain cases, it can be appropriate to suitably support the tension-sensitive textile web not only in the curved area of the shaft, but also in a straight section of the shaft. For example, a continuous perforated band could be arranged in a straight section of the shaft, the perforated band being placed under a vacuum. The textile web will in this way be forced against the perforated band and thus protected from excessive tensile loading. The perforated band could also be wrapped around the rollers, so that the textile web in the curved section of the shaft would make contact not directly with the surface of the rollers, but rather on the perforated band.

BRIEF DESCRIPTION OF THE DRAWINGS

Embodiments of the invention are shown in the drawings and will be more closely described below.

DESCRIPTION OF THE PREFERRED EMBODIMENT

Figure 1:
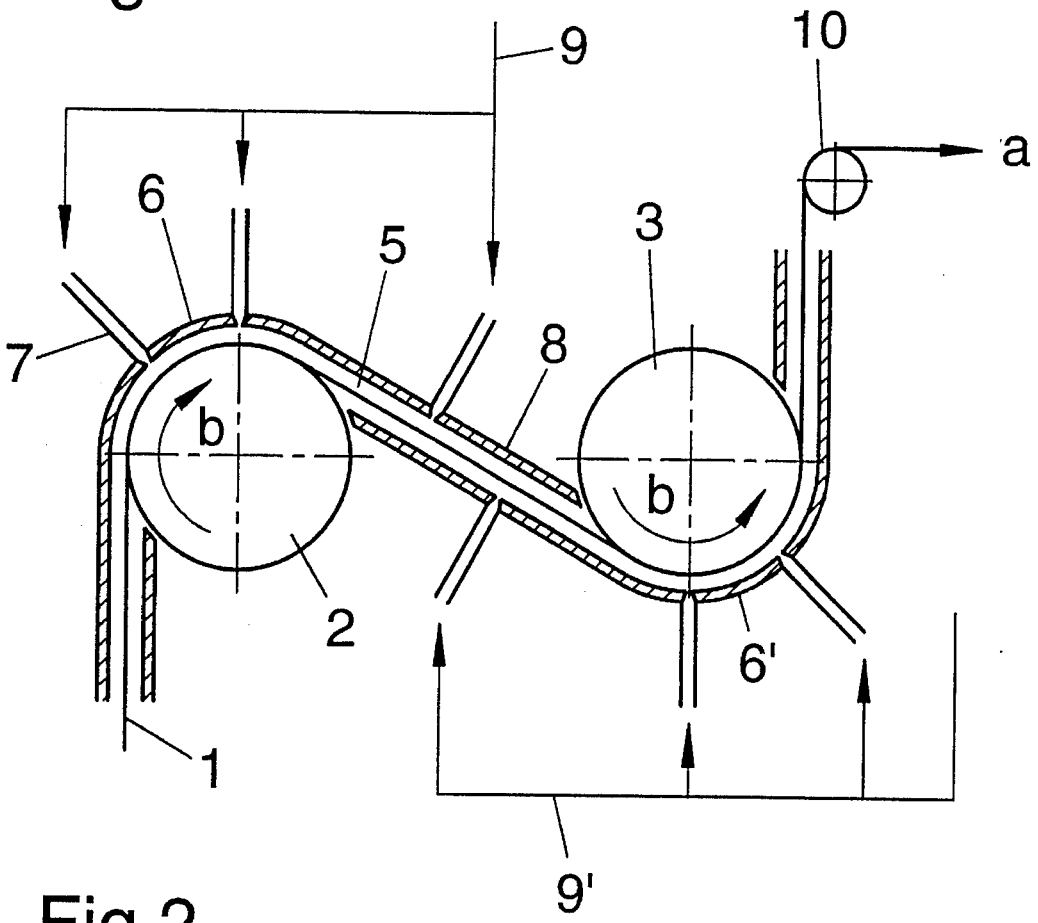
FIG. 1 is a longitudinal section through a shaft possessing two rollers and with a straight intermediate section.

Highly diagrammatic, FIG. 1 shows a textile web 1, for example knitted goods which are sensitive to tension, the textile web being guided through a relatively restricted shaft 5 over preferably two driven rollers 3 and 4. The textile web is transported further over a deflection roller 10 in the direction of the arrow a. At the same time, the rollers rotate in the direction b, with the roller 10 also able to be a driven roller. In the wrap-around area of the rollers, the shaft 5 possesses two curved sections 6, and 6', with the surface of the rollers directly forming a section of the shaft at these locations. Nozzles 7 are arranged in the curved sections, the nozzles being connected to supply piping 9 or 9'. These nozzles can be cone-type nozzles or slotted nozzles extending over the entire width of the textile web. A straight section 8 is arranged between the rollers 2 and 3, on which nozzles 7 are likewise arranged on both sides of the textile web. Evidently, the textile web in this arrangement is subjected to curvature at least once on each side and at the same time acted upon by the treatment medium. The intensive mechanical loading on the textile web, combined with the treatment medium injected under pressure into the shaft, leads to deep penetration of the textile web. Vibration of the textile web can result in the free straight sections, which will further improve the effect. The rollers can possess a diameter of, for example, 40–80 cm. A mixture of vapour, air and water can be applied through the nozzles, with a treatment liquor other than water also being conceivable. The nozzles can either all be connected to the same source of treatment medium, or individual nozzles or groups of nozzles can be connected to different sources of treatment medium.

Figure 2:
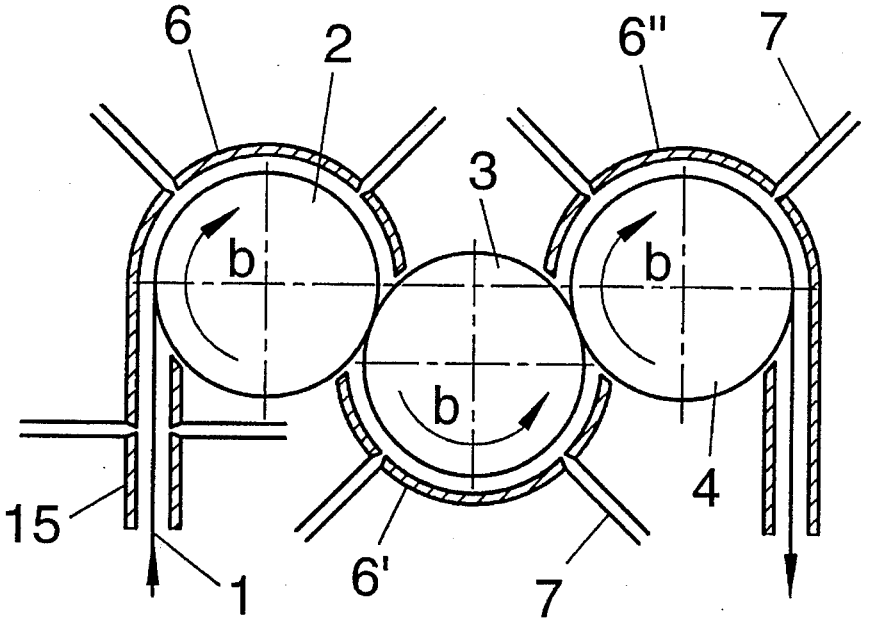
FIG. 2 is a longitudinal section through a shaft with three rollers for web guidance with a continuously constrained web path.

FIG. 2 shows an alternative embodiment of a treatment device with which the shaft is formed by three rollers 2, 3 and 4, said rollers guiding the web along a continuously constrained web path. Here, too, at least one nozzle is arranged in the area of each curvature 6, 6' and 6''. A pair of nozzles is also provided in the straight inlet section 15 of the shaft.

Figure 3:
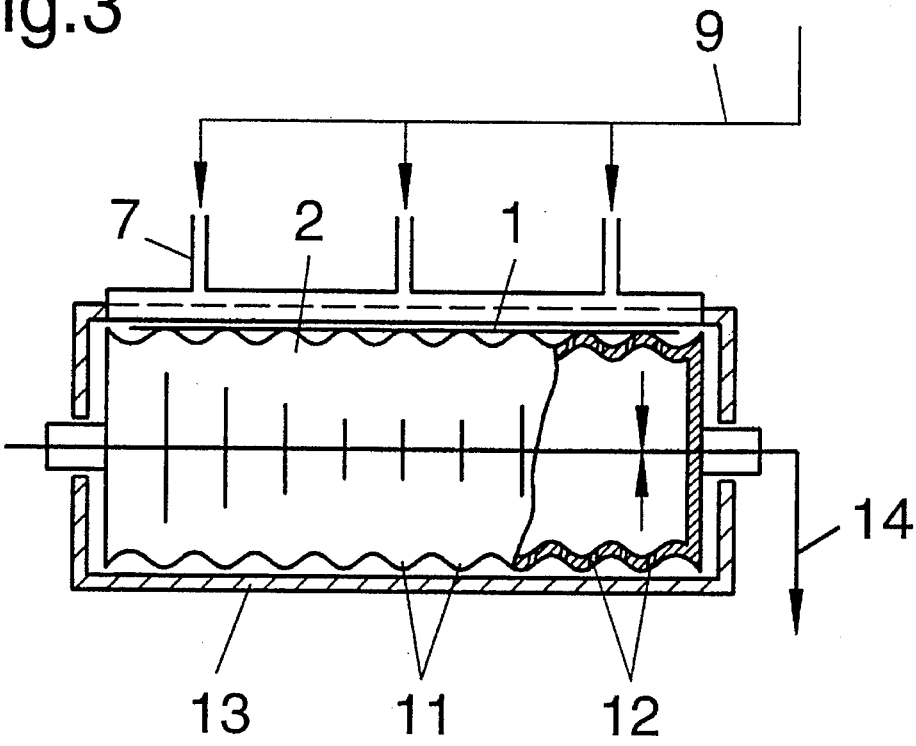
FIG. 3 is a cross section through a shaft with a corrugated roller and hollow drive-shaft.

FIG. 3 shows a cross section through a shaft in the area of a roller 2, the roller being provided with circumferential corrugations 11. The roller is designed as a hollow roller and is provided with openings 12. A suction pipe 14 leads into the inside of the roller so that vapour and/or liquid can be removed by suction. The nozzle 7 is designed as a continuous slotted nozzle with individual connections. The wall of the shaft 13 completely encloses the roller, around its entire outer circumference, with a definite shaft width naturally being provided only in the region of the textile web 1. On the rear side, the shaft wall 13 encloses the roller to the extent that contact is only just avoided. As suggested in FIGS. 1 and 2, the shaft wall 13 could enclose the rollers only in the wrap-around areas, with suitable seals naturally being required to be incorporated with regard to the freely rotating roller sections.

Figure 4:
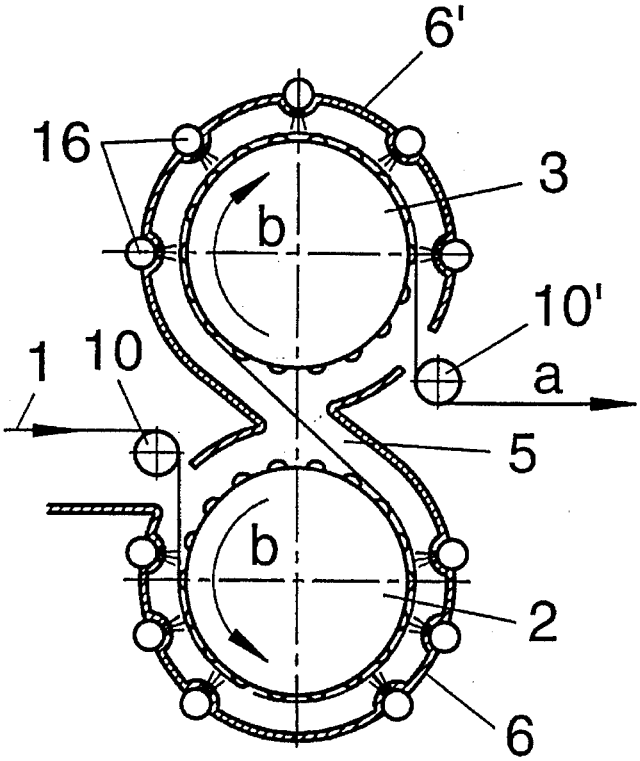
FIG. 4 is a longitudinal section through an embodiment with an S-shaped shaft arrangement.

With the embodiment according to FIG. 4, the shaft 5 has an approximately S-shaped cross-sectional design. The deflection roller 10 guides the textile web 1 from the horizontal directly into the curved area 6 of the first roller 2. Extraction over the deflection roller 10' is done at almost the same level in the direction of the arrow a. A vapour-air-water mixture is applied to the textile web from the collector tubes 16 integrated into the wall of the shaft. The driven rollers or drums 2 and 3 can possess a structured surface so that the textile web only makes partial contact. As a result, sections will be formed which can oscillate freely under the influence of the treatment medium.

Figure 5:
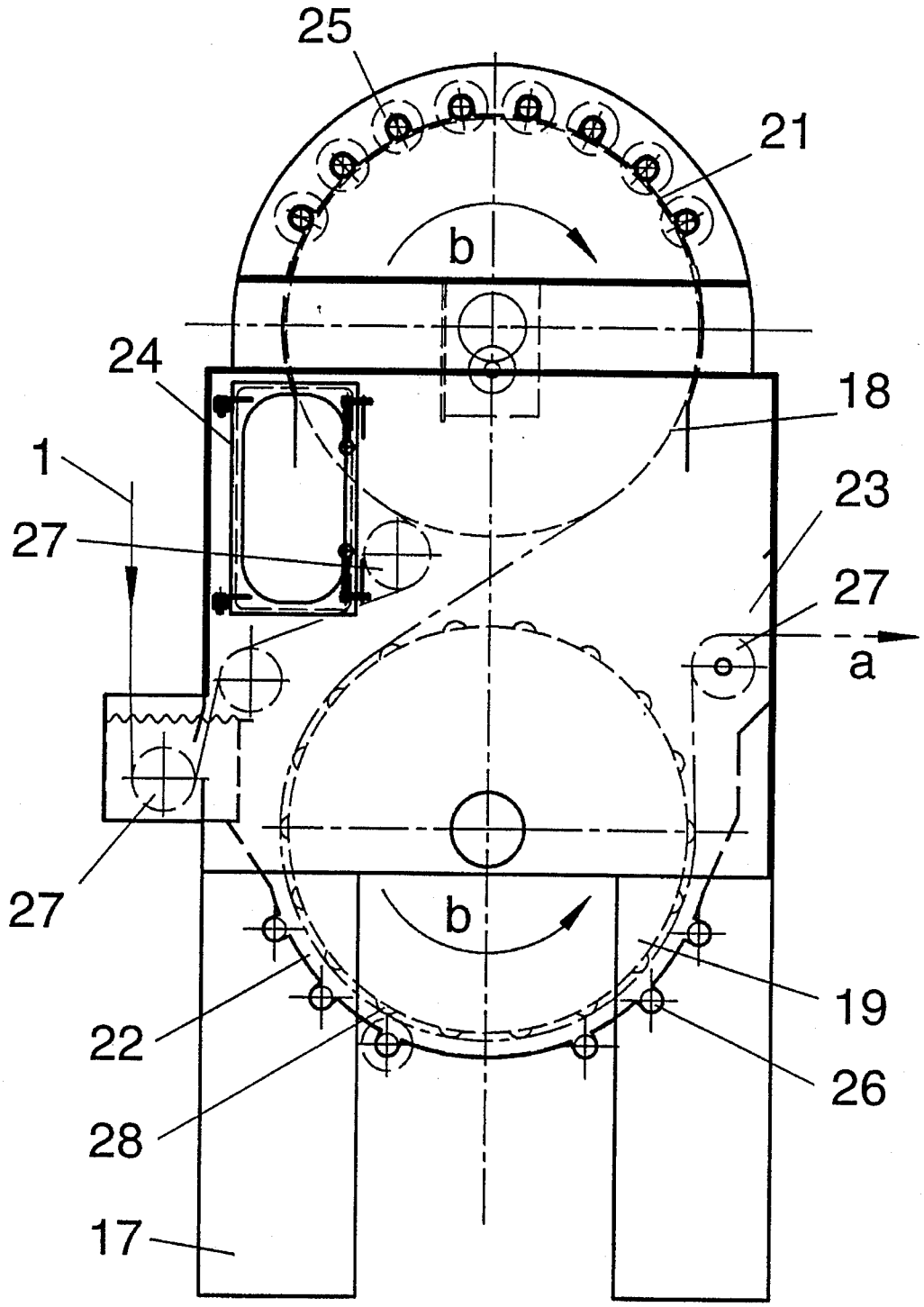
FIG. 5 is a cross section through a washing compartment with two rollers, one placed above the other.
Figure 6:
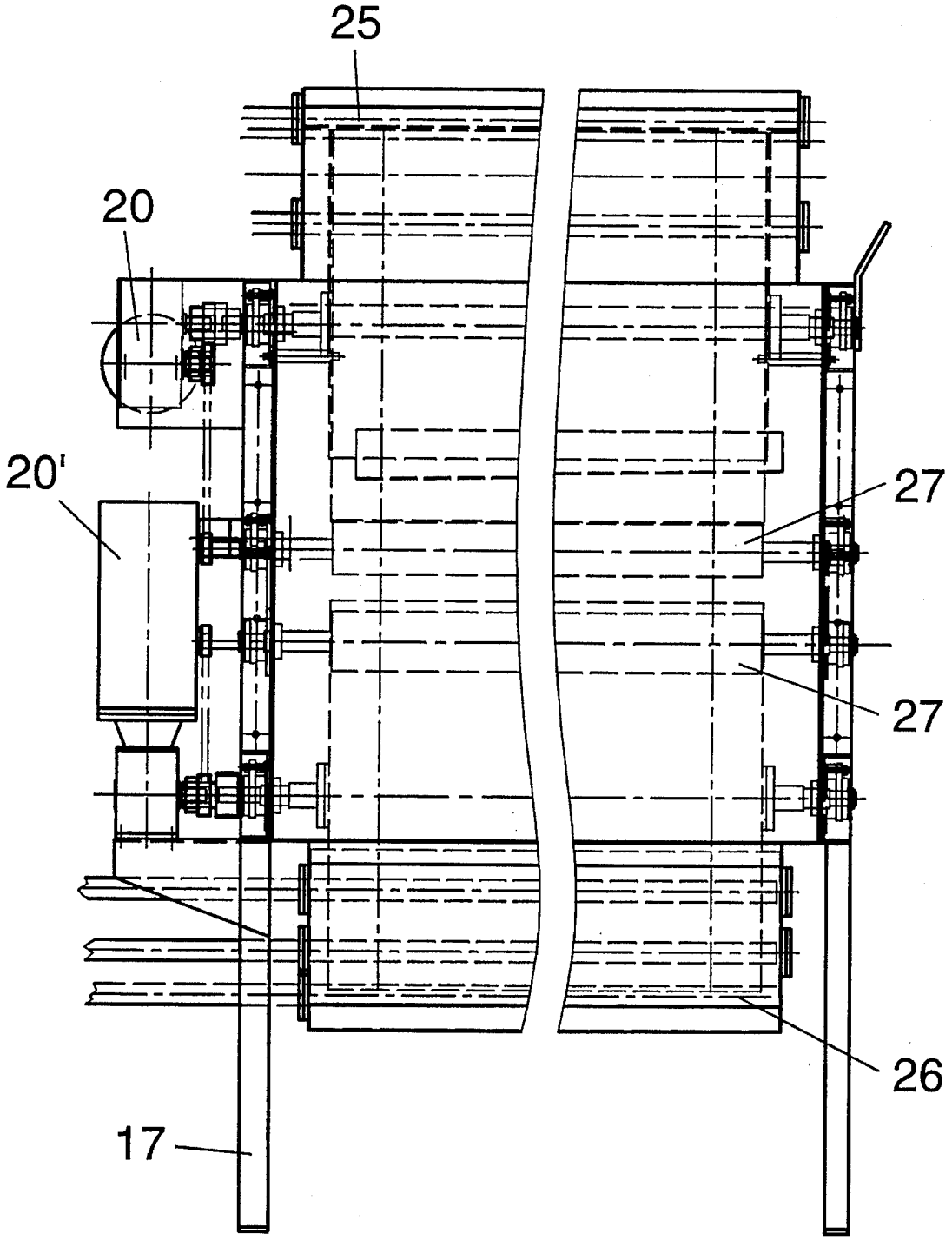
FIG. 6 is a somewhat truncated view of the machine according to FIG. 5, seen in the direction of feed.

In the case of the washing machine according to FIGS. 5 and 6, the arrangement of rollers is in principle the same as in the embodiment according to FIG. 4. An upper drum 18 and a lower drum 19 is in each case mounted in bearings to rotate in a machine frame 17. The rotational axes of both drums lie in the same vertical plane. Drive motors 20, 20' are arranged outside on the machine frame, said motors not only driving both the drums by means of toothed belts or v-belts, but also the individual deflection rollers 27.

An upper shaft 21 is arranged at the upper drum 18 which extends approximately 180° over the upper surface of said drum. The distance between the drum and the wall of the shaft is extremely small, for example 5 mm. A plurality of upper nozzle-tubes 25 extend over the entire width of the shaft, said tubes being equipped with slotted nozzles or with bores.

The lower drum 19 is equipped with individual corrugations 28 at regular intervals, so that the textile web makes only linear contact. The lower shaft 22 extends around the bottom surface of the drum 19, likewise through an angle approaching 180°. In comparison to the upper shaft, however, the lower shaft has a considerably greater distance between the drum and the wall of the shaft of 10–40 mm. Nozzle tubes 26 extending over the entire width of the shaft are also arranged at the lower shaft.

The facing drum surfaces which are not associated with a shaft are connected by a common housing 23. A plurality of window-flaps 24 are arranged in the sides of the said housing, those flaps facilitating the introduction of the textile web and permitting monitoring of the washing process during operation.

As opposed to the embodiment according to FIG. 4, the textile web 1 is guided over deflection rollers 27 first of all to the upper drum 18, although wrapping around the rollers approximately is likewise in an S-shape. In the upper shaft 21, the textile web is intensively acted upon with vapour, if necessary also alternating with fresh water.

The transition to the lower drum 19 follows with a free span within the housing 23. The lower shaft 22 is completely filled with liquor, although this liquor is continuously replaced. Liquor is pumped under pressure against the surface of the textile web through the nozzle tubes 26. The nozzle tubes 26 could, however, be switched off and the supply or recirculation of liquor could be carried out using another means.

The textile web is extracted from the washing compartment around a further deflection roller in the direction of the arrow a. Preferably, a plurality of such washing compartments are connected in series.

Figure 7:
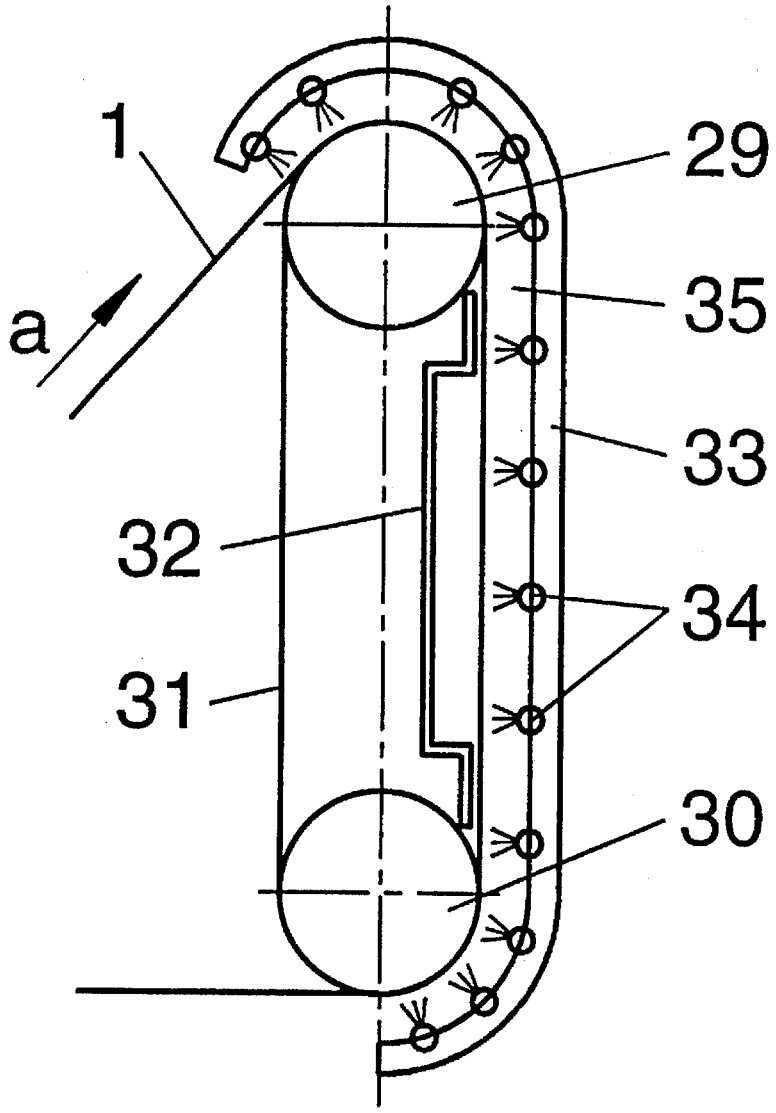
FIG. 7 shows a further embodiment possessing a perforated band for supporting the textile web.

With the embodiment according to FIG. 7, the textile web 1 is guided through the shaft 35 on a perforated band 31. The continuous perforated band is tensioned between an upper roller 29 and a lower roller 30. Nozzles 34 are arranged in the wall of the shaft 33, said wall extending around the surface of the rollers. In the straight area of the shaft, a partial-vacuum chamber 32 is arranged on the inside of the perforated band, said chamber being open towards the perforated band. In the area of this partial-vacuum chamber, the textile web 1 is evidently pressed against the perforated band and thus stabilised in the straight area of the shaft. In addition, the partial-vacuum also causes the treatment medium which has been sprayed onto the side oriented away from the chamber 32 to be drawn by suction though the textile web. The suction effect could of course also be maintained in the area of both the rollers 29, 30 by designing these rollers as perforated rollers.

Inasmuch as the invention is subject to modifications and variations, the foregoing description and accompanying drawings should not be regarded as limiting the invention, which is defined by the following claims and various combinations thereof.

What is claimed is a:

1. Method of treating a tension-sensitive textile web with a treatment medium, said method comprising steps of moving the textile web over at least two rollers, through a narrow shaft defined by walls, said walls having at least one curved segment formed in part by a surface portion of one of said rollers, and applying said treatment medium under pressure to the web at said curved segment.

2. Method according to claim 1, characterized in that the textile web (1) is, on each of its sides, deflected around a roller and that treatment medium is applied at each point of deflection.

3. Method according to claim 1 or 2, characterized in that the textile web (1) is guided around the rollers with a continuously constrained web path.

4. Method according to claim 1, characterized in that the textile web is first of all guided around an upper roller where treatment medium is applied under pressure, and that the textile web is then guided around a lower roller where said textile web is immersed into a bath containing liquid treatment medium.

5. Method according to claim 1, characterized in that a treatment medium is applied which is at least partially vaporific.

6. Method according to claim 5, characterized in that, in relation to the course of the shaft, liquid and vaporific medium is applied alternately.

7. Device for treatment of tension-sensitive textile web (1), said device having at least two rollers (2, 3) arranged consecutively in the direction of transport (a) and a device for directing a treatment medium against the textile web, wherein the surface of at least one of said rollers (2, 3) at least partially forms a limiting wall of a curved section of a narrow shaft (5) through which the textile web is transported and wherein nozzles (7) for pressurized application of the treatment medium are arranged in the curved section (6) of the shaft.

8. Device according to claim 7, characterized in that two rollers form at least two opposingly curved sections.

9. Device according to claim 8, characterized in that a straight shaft section (8) is arranged between both the curved sections of the shaft.

10. Device according to claim 9, characterized in that nozzles (7) are likewise arranged on both sides of the straight section (8) of the shaft.

11. Device according to claim 7, characterized in that two rollers are arranged one above the other, a shaft being arranged at the upper roller to extend around the upper surface of the roller and a shaft being arranged at the lower roller to extend around the lower surface of the roller, and that the facing surfaces of the rollers which are not associated with a shaft are enclosed by a common housing.

12. Device according to claim 7, characterized in that the nozzles are or can be connected to differing treatment medium sources.

13. Device according to claim 7, characterized in that at least one roller is formed to be permeable, and in particular is formed as a perforated drum.

14. Device according to claim 7, characterized in that at least one roller is formed as a circumferentially or axially corrugated roller.

15. Device according to claim 7, characterized in that the curved shaft possesses a distance between the shaft walls of 3 to 40 mm, preferably 5 to 10 mm.

* * * * *